United States Patent [19]

Sidransky

[11] Patent Number: 4,859,145

[45] Date of Patent: Aug. 22, 1989

[54] COMPRESSOR WITH SUPERCRITICAL DIFFUSER

[75] Inventor: Fred Sidransky, San Diego, Calif.

[73] Assignee: Sundstrand Corporation, Rockford, Ill.

[21] Appl. No.: 109,324

[22] Filed: Oct. 19, 1987

[51] Int. Cl.[4] ..... F04D 29/44

[52] U.S. Cl. ..... 415/211.1

[58] Field of Search ..... 415/181, 211, DIG. 1

[56] References Cited

U.S. PATENT DOCUMENTS

| | | | |
|---|---|---|---|
| 2,247,817 | 7/1941 | McMahan | 415/211 |
| 2,380,772 | 7/1945 | McMahan | 415/211 X |
| 2,435,236 | 2/1948 | Redding | 415/181 |
| 3,184,152 | 5/1965 | Bourquard | 415/211 |
| 3,356,289 | 12/1967 | Plotkowiak | 415/211 |
| 3,424,372 | 1/1969 | Blattner et al. | 415/211 |
| 3,442,441 | 5/1969 | Dettmering | 415/181 |
| 3,460,748 | 8/1969 | Erwin | 415/211 X |
| 3,588,270 | 6/1971 | Boelcs | 415/162 |
| 3,658,437 | 4/1972 | Soo | 415/181 |
| 3,724,968 | 4/1973 | Friberg et al. | 415/181 |
| 3,765,792 | 10/1973 | Exley | 415/181 |
| 3,781,128 | 12/1973 | Bandukwalla | 415/181 |
| 3,861,826 | 1/1975 | Dean, Jr. | 415/211 |
| 3,917,434 | 11/1975 | Bandukwalla | 415/211 |
| 4,027,997 | 6/1977 | Bryans | 415/207 |
| 4,099,891 | 7/1978 | Campbell | 415/207 |
| 4,164,845 | 8/1979 | Exley et al. | 60/39.29 |
| 4,315,714 | 2/1982 | Exley et al. | 415/207 |
| 4,354,802 | 10/1982 | Nishida et al. | 415/207 |

FOREIGN PATENT DOCUMENTS

| | | | |
|---|---|---|---|
| 971224 | 1/1951 | France | 415/211 |
| 317623 | 11/1953 | Switzerland | 415/211 |
| 524012 | 11/1976 | U.S.S.R. | 415/211 |
| 879047 | 11/1981 | U.S.S.R. | 415/211 |

*Primary Examiner*—Robert E. Garrett
*Assistant Examiner*—Joseph M. Pitko
*Attorney, Agent, or Firm*—Wood, Dalton, Phillips, Mason & Rowe

[57] ABSTRACT

Losses in a diffuser 26 for a radial discharge compressor including an impeller 10 with impeller blades 16 terminating in radially outer discharge ends 18 are minimized by means of first and second stages of diffuser vanes 30 and 32, which vanes 30 and 32 have cross sectional shapes configured as supercritical airfoils.

6 Claims, 1 Drawing Sheet

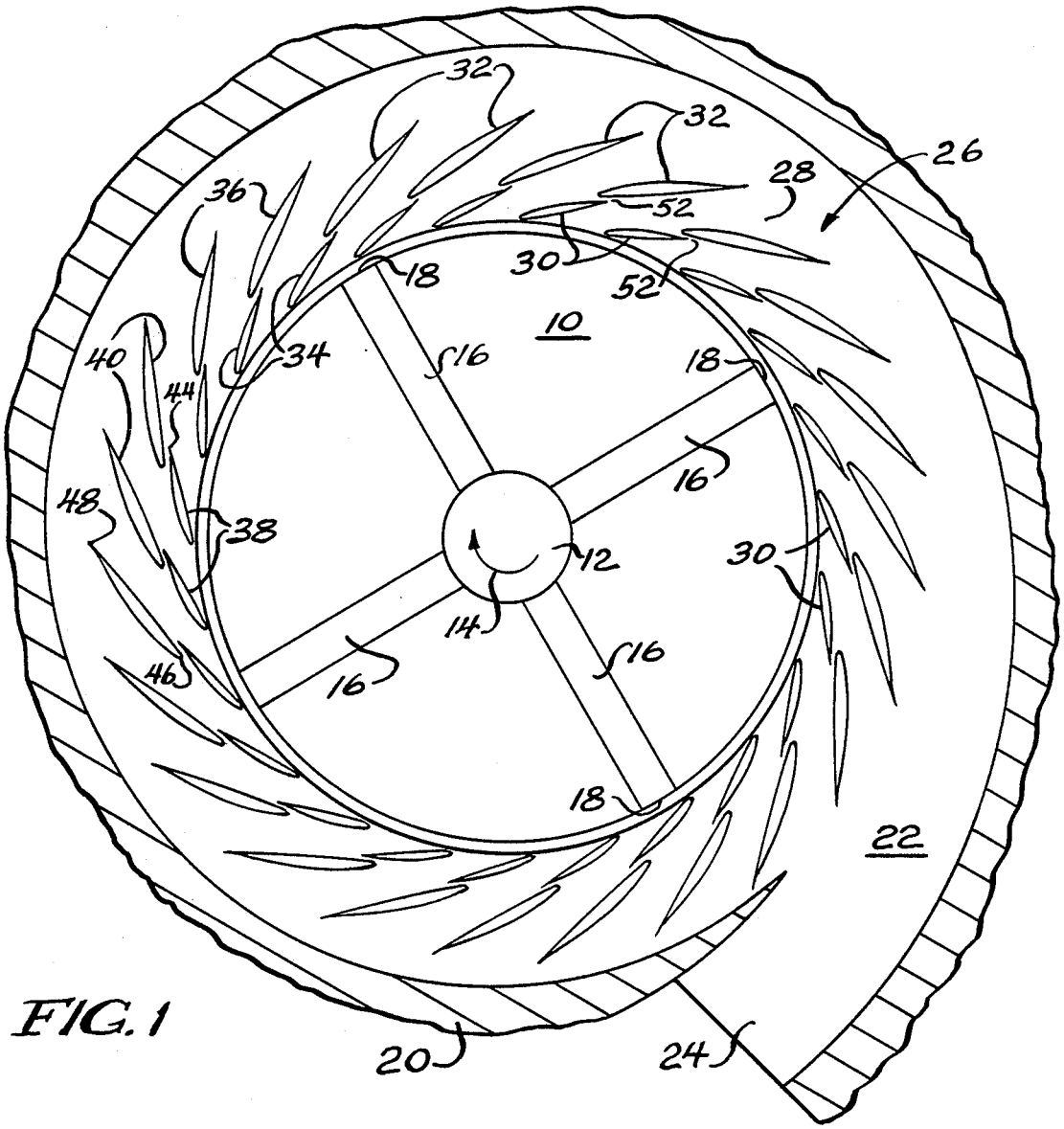
FIG. 1
FIG. 2
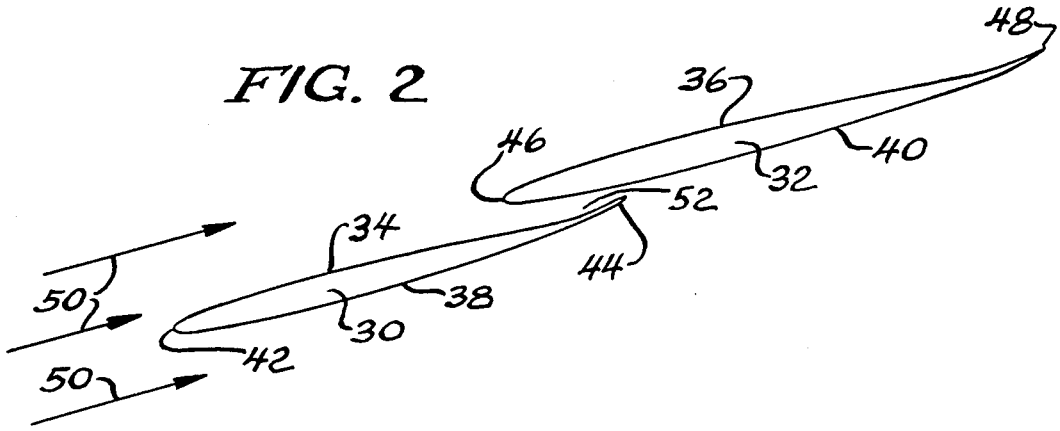

COMPRESSOR WITH SUPERCRITICAL DIFFUSER

FIELD OF THE INVENTION

This invention relates to diffusers for compressors, and more specifically, to a multiple stage, vaned diffuser for a radial discharge compressor.

BACKGROUND OF THE INVENTION

Diffusers are employed in compressors to convert what may be referred to as a "velocity head" to a "pressure head". It is, of course, highly desirable that this conversion be made with minimal losses since such losses reduce the efficiency of the operation of the machine employing the compressor.

One means of cutting diffuser losses resides in employing a so-called cascade diffuser wherein the vanes are arranged in two or more stages. The vanes in the first stage are located radially inward of the vanes in the second stage with the latter also being downstream of the former in the direction of air flow in the diffuser. Examples of this approach may be found in U.S. Pat. Nos. 3,588,270 issued June 28, 1971 to Boeics and 3,861,826 issued Jan. 21, 1975 to Dean as well as Paper No. 72-GT-39 published by the American Society of Mechanical Engineers and authored by R. C. Pampreen.

Even though these cascade diffusers reduce losses, because transonic velocity occurs in such diffusers, undesirable shock waves may be generated which create losses and otherwise detract from diffuser performance.

The present invention is directed to overcoming the above problem.

SUMMARY OF THE INVENTION

It is the principal object of the invention to provide a new and improved diffuser for a radial discharge compressor. More specifically, it is an object of the invention to provide a cascade diffuser having plural stages of vanes and wherein the vanes of at least the first stage are configured as supercritical airfoils to minimize losses occurring within the diffuser.

An exemplary embodiment achieves the foregoing object in a radial discharge compressor including a impeller rotatable about an axis and having blades extending from a radially inward position to a radially outward position to terminate in radially outermost discharge ends. An annular collector surrounds the impeller in radially spaced relation with respect thereto and includes at least one compressed gas discharge port. An annular diffuser is disposed between the discharge ends of the impeller vanes and the collector. The diffuser has a radially inner first stage made up of a plurality of radially inner diffuser vanes and a radially outer second stage made up of a plurality of radially outer diffuser vanes, each aligned with a corresponding one of the inner vanes. Each of the vanes has a leading edge and a trailing edge with each trailing edge being radially outward of the leading edge of the associated vane and displaced circumferentially from the leading edge of the associated vane in the direction of rotation of the impeller. According to the invention, at least the vanes of the first stage have cross sections configured as supercritical airfoils.

In a preferred embodiment of the invention, the trailing edges of the vanes of the first stage are separated from the leading edges of the vanes of the second stage in such a way as to define high speed jets.

In a highly preferred embodiment of the invention, the vanes at both of the stages have cross sections configured as supercritical airfoils.

A highly preferred embodiment of the invention contemplates that the leading and trailing edges of the vanes are interconnected by spaced, high and low pressure surfaces and that the airfoils be positioned to have their high pressure surfaces located radially outwardly of their low pressure surfaces.

In addition, the invention contemplates that the leading edges of the vanes of the second stage be in advance of the trailing edges of the corresponding vane of the first stage in the direction of gas flow.

Other objects and advantages will become apparent from the following specification taken in connection with the accompanying drawings.

DESCRIPTION OF THE DRAWINGS

FIG. 1 is a sectional view of a radial discharge compressor made according to the invention; and FIG. 2 is an enlarged, fragmentary view of two vanes employed in a diffuser.

DESCRIPTION OF THE PREFERRED EMBODIMENT

An exemplary embodiment of a radial discharge, centrifugal compressor is illustrated in FIG. 1 and with reference thereto is seen to include an impeller 10 mounted on a shaft 12 for rotation in the direction of an arrow 14. The shaft 12 is driven by a motor (not shown) and compressor will be provided an inlet for the gas to be compressed that is coaxial with the rotational axis of the shaft 12.

The impeller 10 includes a plurality of vanes or blades 16 which extend radially outward to terminate in outermost discharge ends 18. It is to be particularly noted that the configuration of the vanes 16 and the ends 18 may be conventionally determined and forms no part of the present invention.

An annular collector 20 is located radially outwardly of the impeller 10 in surrounding and spaced relation thereto. The collector 20 may be of conventional configuration and as illustrated in FIG. 1 includes a conventional volute 22 that opens toward the impeller 10 and which terminates in a compressed gas discharge port 24.

Interposed between the impeller 10 and the collector 20 is an annular diffuser, generally designated 26. The diffuser 26 may be comprised of at least one generally circular plate 28 upon which a first stage of diffuser vanes 30 is mounted at a radially inner position adjacent the discharge ends 18 of the impeller vanes 16. The plate 28 also mounts a second stage of diffuser vanes 32 which are located radially outward of the first stage 30 and which are aligned with corresponding ones of the vanes 30 of the first stage.

According to the invention, the vanes 30, and preferably the vanes 32 as well, have cross sections configured as supercritical air foils. The term "supercritical airfoil" is used in a conventional sense and refers to an airfoil that is characterized by very little camber in the forward portion with a severe camber at the rear portion.

The vanes 30 have high pressure sides 34 while the vanes 32 have high pressure sides 36. In addition, the vanes 30 have low pressure sides 38 while the vanes 32 have lower pressure sides 40. As used herein, the low pressure side is that that would be subjected to the least pressure if the vane were employed as a wing. Stated another way, if the vanes were employed as wings, lift in the aerodynamic sense would be operating against the high pressure surfaces 34 and 36.

In any event, according to the invention, the high pressure surfaces 34 and 36 are located radially outwardly of the low pressure surfaces 38 and 40.

Where the surfaces 34 and 38 for the vanes 30 meet, leading edges 42 and trailing edges 44, in relation to the direction of air flow from the impeller 12, are formed. The vanes 32 likewise have leading edges 46 and trailing edges 48 and it will be appreciated from the drawings that the leading edges 46 of the vanes 32 of the second stage are in advance of the trailing edges 44 of the corresponding vanes 30 in the first stage in the direction of gas flow, shown by arrows 50 in FIG. 2. The leading edges 46 are also slightly spaced from the trailing edges 44 and as a consequence, high speed jets 52 for the compressed gas are formed at those locations.

As a result of this construction, the shock waves that are present on the low pressure surfaces of airfoils of conventional construction at transonic velocities are minimized thereby minimizing a source of operational inefficiency. Furthermore, the use of a supercritical airfoil configuration in forming the vanes 30 provides excellent boundary layer control and allows the radial length of the diffuser to be minimized.

The fact that the shock waves are reduced helps maintain the air flow on the surfaces 34, 36, 38, 40 thereby taking advantage of a greater percentage of the surface area of the diffuser vanes 30 and 32 for better efficiency. Similarly, the jets 52 assist in maintaining air flow on the surface of the vanes 32 so that the area of the vanes is more effectively used enabling the previously mentioned relatively short radial length.

I claim:

1. A radial discharge compressor comprising:

an impeller rotatable about an axis and including blades extending from a radially inward position to a radially outward position to terminate in radially outermost discharge ends;

an annular collector surrounding said impeller in radially spaced relation including at least one compressed gas discharge port; and an annular diffuser interposed between said discharge ends and said collector, said diffuser having a radially inner first stage made up of a plurality of radially inner diffuser vanes and a radially outer second stage made up of a plurality of radially outer diffuser vanes, each aligned with a corresponding one of said inner vanes;

each of said vanes having a leading edge and a trailing edge with each trailing edge being radially outward of the leading edge of the associated vane and displaced circumferentially from the leading edge of the associated vane in the direction of rotation of said impeller;

at least the vanes of said first stage having cross sections configured as supercritical airfoils.

2. The radial discharge compressor of claim 1 wherein the trailing edges of the vanes of the first stage are separated from the leading edges of the vanes of the second stage so as to define high speed jets.

3. The radial discharge compressor of claim 2 wherein the vanes of both said stages have cross sections configured as supercritical airfoils.

4. A radial discharge compressor comprising:

an impeller rotatable about an axis and including blades extending from a radially inward position to a radially outward position to terminate in radially outermost discharge ends;

an annular collector surrounding said impeller in radially spaced relation including at least one compressed gas discharge port; and an annular diffuser interposed between said discharge ends and said collector, said diffuser having a radially inner first stage made up of a plurality of radially inner diffuser vanes and a radially outer second stage made up of a plurality of radially outer diffuser vanes, each aligned with a corresponding one of said inner vanes;

each of said vanes having a leading edge and a trailing edge connected by spaced, high and low pressure surfaces, each trailing edge being radially outward of the leading edge of the associated vane and displaced circumferentially from the leading edge of the associated vane in the direction of rotation of said impeller;

at least the vanes of said first stage having cross sections configured as supercritical airfoils and positioned to have their high pressure surfaces located radially outward of their low pressure surfaces.

5. The radial discharge compressor of claim 4 wherein the leading edges of the vanes of said second stage are in advance of the trailing edges of the corresponding vanes of said first stage in the direction of gas flow and are slightly spaced therefrom to form high speed jets.

6. The radial discharge compressor of claim 5 wherein the vanes of said second stage have cross sections configured as supercritical airfoils and are positioned to have their high pressure surfaces located radially outward of their low pressure surfaces.

* * * * *